US007188844B2

(12) United States Patent
Hinds

(10) Patent No.: US 7,188,844 B2
(45) Date of Patent: Mar. 13, 2007

(54) SEATING APPARATUS

(76) Inventor: Jason Mark Hinds, 8/36 Seaview Street, Cronulla NSW 2230 (AU)

( * ) Notice: Subject to any disclaimer, the term of this patent is extended or adjusted under 35 U.S.C. 154(b) by 0 days.

(21) Appl. No.: 10/740,919

(22) Filed: Dec. 22, 2003

(65) Prior Publication Data

US 2005/0099038 A1 May 12, 2005

Related U.S. Application Data

(63) Continuation of application No. 09/858,480, filed on May 17, 2001, now abandoned.

(30) Foreign Application Priority Data

May 17, 2000 (AU) ..... PR1659

(51) Int. Cl.
*A47C 12/02* (2006.01)

(52) U.S. Cl. ..... 280/47.25; 280/47.18; 280/652; 182/33; 297/184.14

(58) Field of Classification Search ..... 280/47.17, 280/47.18, 47.19, 47.24, 47.25, 651, 652, 280/654; 182/20, 116, 115, 33, 33.3; 297/184.4, 297/16.1, 463.2
See application file for complete search history.

(56) References Cited

U.S. PATENT DOCUMENTS 2,691,405 A * 10/1954 Hinch ..... 182/33.2
2,990,764 A * 7/1961 Wilder ..... 182/127
3,059,722 A * 10/1962 Rouse ..... 182/33
3,104,889 A * 9/1963 Branch, Jr. ..... 280/30
4,045,040 A * 8/1977 Fails ..... 280/1.5
4,742,888 A * 5/1988 Amacker ..... 182/116
4,777,672 A * 10/1988 Gebhard et al. ..... 4/449
5,009,283 A * 4/1991 Prejean ..... 182/116
6,158,749 A * 12/2000 Roudebush ..... 280/47.16
6,497,424 B2 * 12/2002 Gartner et al. ..... 280/47.4
6,880,835 B2 * 4/2005 Tornabene et al. ..... 280/30
6,883,267 B1 * 4/2005 Pruitt ..... 43/54.1

* cited by examiner

*Primary Examiner*—Jeff Restifo
(74) *Attorney, Agent, or Firm*—Stites & Harbison PLLC; Douglas E. Jackson

(57) ABSTRACT

Seating apparatus features a body including a seat and a lid which is pivotable with respect to the body between a retracted position and an extended position in which the lid defines a cover for the seat. In the retracted position, the lid cooperates with the body to enclose the seat against use. The lid is attached to the body at a pivot point which is positioned adjacent to the seat. When the lid is pivoted into the extended position, the apparatus includes a telescopic member positioned between the lid and the body to enable the lid to be supported open. The body includes a plurality of steps and can be fitted with one or more wheels to allow movement of the apparatus and to permit tilting of the apparatus into a position whereat the seat is located uppermost and the steps enable climbing into the seat.

28 Claims, 12 Drawing Sheets

SEATING APPARATUS

This application is a continuation of application Ser. No. 09/858,480, filed on May 17, 2001, now abandoned.

FIELD OF THE INVENTION

The present invention relates to seating apparatus. For example the invention can be employed as seating for use on beaches as a lifeguard surveillance station and will be described with reference to this context. It should be remembered, however, that the invention has broader use in the provision of all manner of raised and covered seating situations, for example in schoolyard or sporting applications.

BACKGROUND ART

Apparatus for forming temporarily or permanently covered seating is known in the art. Such devices usually comprise non-rigid covers which provide only temporary physical coverage of the seat itself. It would be advantageous if alternative seating apparatus incorporating a cover could be provided.

SUMMARY OF THE INVENTION

The present invention provides seating apparatus including:

a base including a seat and one or more steps associated with the base for leading up to the seat; and a member moveable with respect to the base between a retracted position and an extended position in which the member is disposed over the seat.

When the expression "disposed over the seat" is employed here throughout it includes orientations in which the member is located in use vertically above the seat as well as above but offset with respect to the seat, such as may provide a shelter from sun, rain, wind etc.

The member is connected to the base for movement between the retracted and extended positions. In one form of the invention the member is pivotable at the base between the retracted and extended positions. Preferably in the retracted position the member cooperates with the base to enclose the seat against use. Preferably in the retracted position the member cooperates with the base to also enclose the step(s) against use. Preferably the member is attached to the base at a pivot point which is positioned at or adjacent to the seat.

Preferably the apparatus further includes a support positionable between the member and the base or between the member and surrounding ground for supporting the member when in the extended position. Most preferably the support is one or more foldable, extendable or telescopic connectors.

Preferably the member is a segment in the form of an outwardly convex rectangular panel, and the base shape approximates a longitudinal prism, the member sitting flush with the base in the retracted position. Preferably the step(s) and the member define a storage space that is enclosable when the member is in the retracted position.

In a second form of the invention the member is slidable between the retracted and extended positions. Preferably in the retracted position the member cooperates with the base to enclose the seat against use. Preferably the member is attached to the base in a track or slot provided at the base, the track or slot extending along the base adjacent the seat and the step(s) so that in the retracted position the member cooperates with the base to also enclose the step(s) against use.

Preferably the apparatus further includes a support positionable between the member and the base or between the member and surrounding ground for supporting the member when in the extended position. Most preferably the support is one or more foldable, extendable or telescopic connectors.

Preferably the member is a segment in the form of a flexible rectangular panel, and the base shape approximates a longitudinal prism, the member sitting flush with the base in the retracted position. Preferably the step(s) and the member define a storage space that is enclosable by the member when in the retracted position.

In a third form of the invention the member is slidable between the retracted and extended positions. Preferably in the retracted position the member is received in an internal recess provided in an opposing side of the base to the step(s) or in an external retaining track or slot provided on the opposing side.

Preferably the apparatus includes a support positionable between the member and the base or between the member and surrounding ground for supporting the member when in the extended position. Most preferably the support is one or more foldable, extendable or telescopic connectors.

Preferably the member is a segment in the form of a flexible rectangular panel, and the base shape approximates a longitudinal prism, the panel seated within the base or at the opposing side of the base in the retracted position.

Furthermore, in relation to all forms of the invention, the step(s) are incorporated in the base, or are attachable to the base. Preferably the step(s) are part of a ladder that is optionally pivotally mounted to the base. Preferably the base is fitted with one or more wheels to allow movement of the apparatus and to permit tilting of the apparatus into a position whereat the seat is located uppermost in the base and the step(s) are arranged to enable climbing into the seat.

Preferably the base includes a projecting wing at its in use lowermost end that helps stabilise the base when in the upright position.

Preferably the base is further adapted for the external attachment of equipment such as surfcraft, flagpoles etc.

Preferably the base has internal storage defined therein which is enclosed by an access portal provided on an opposing side of the base to the step(s) or enclosed by an access portal provided in the step(s).

The apparatus can be used to provide an improved raised and covered surveillance seat in or near locations as diverse as swimming pools, football fields, school playgrounds and beaches. The invention facilitates the positioning and covering of raised seating in a simple and rapid fashion.

The mobility of the seat can allow repositioning of the apparatus for storage or to follow changing needs during the course of normal activities, for example, as an observation seat for a lifeguard to be moved to follow the constantly changing conditions which occur at various parts of a beach.

BRIEF DESCRIPTION OF THE DRAWINGS

Notwithstanding any other forms which may fall within the scope of the present invention, preferred forms of the invention will now be described, by way of example only, with reference to the accompanying drawings in which.

MODES FOR CARRYING OUT THE INVENTION

Figure 1:
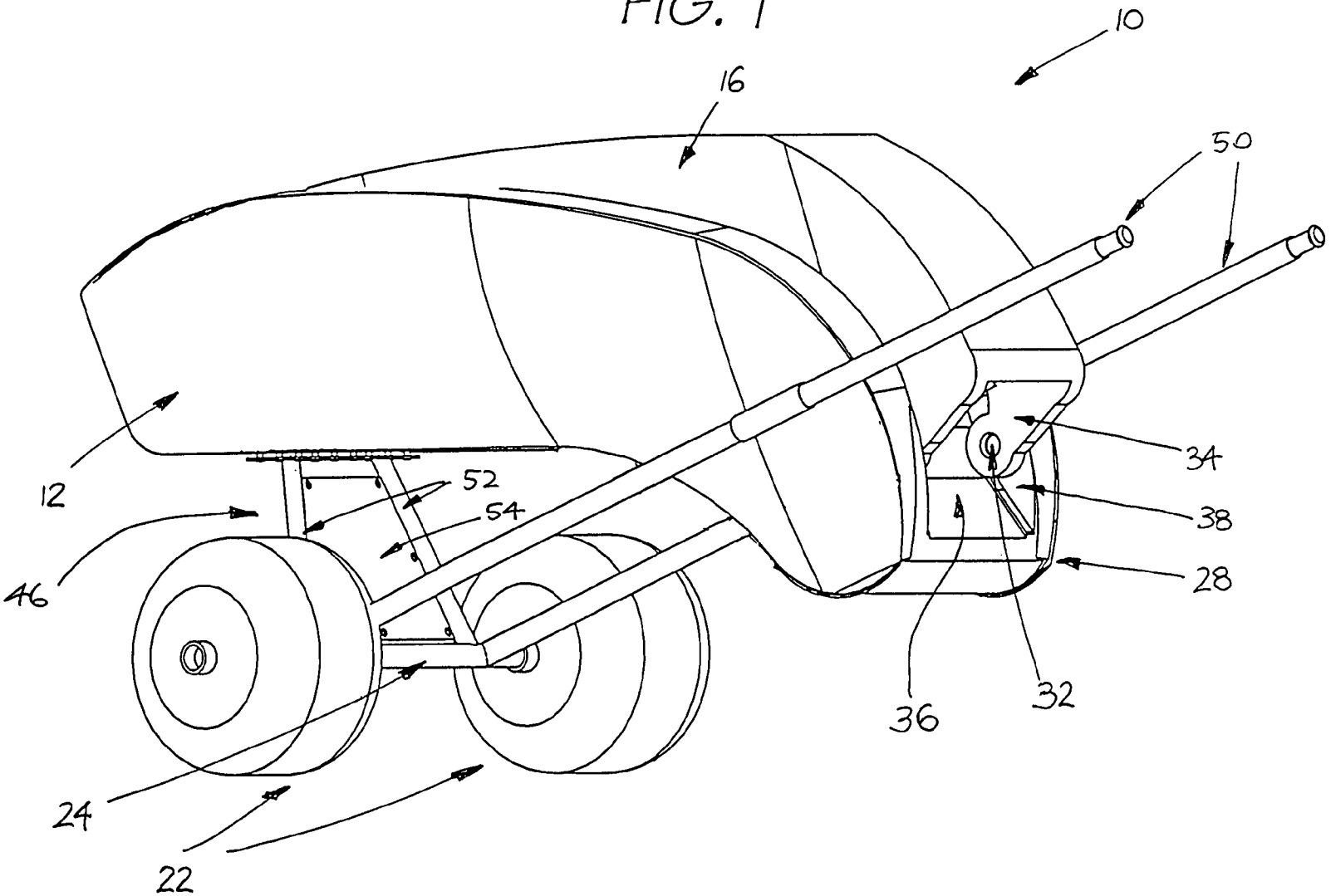
FIG. 1 shows a perspective schematic view of one embodiment of an apparatus for a seating apparatus in accordance with the invention.
Figure 2:
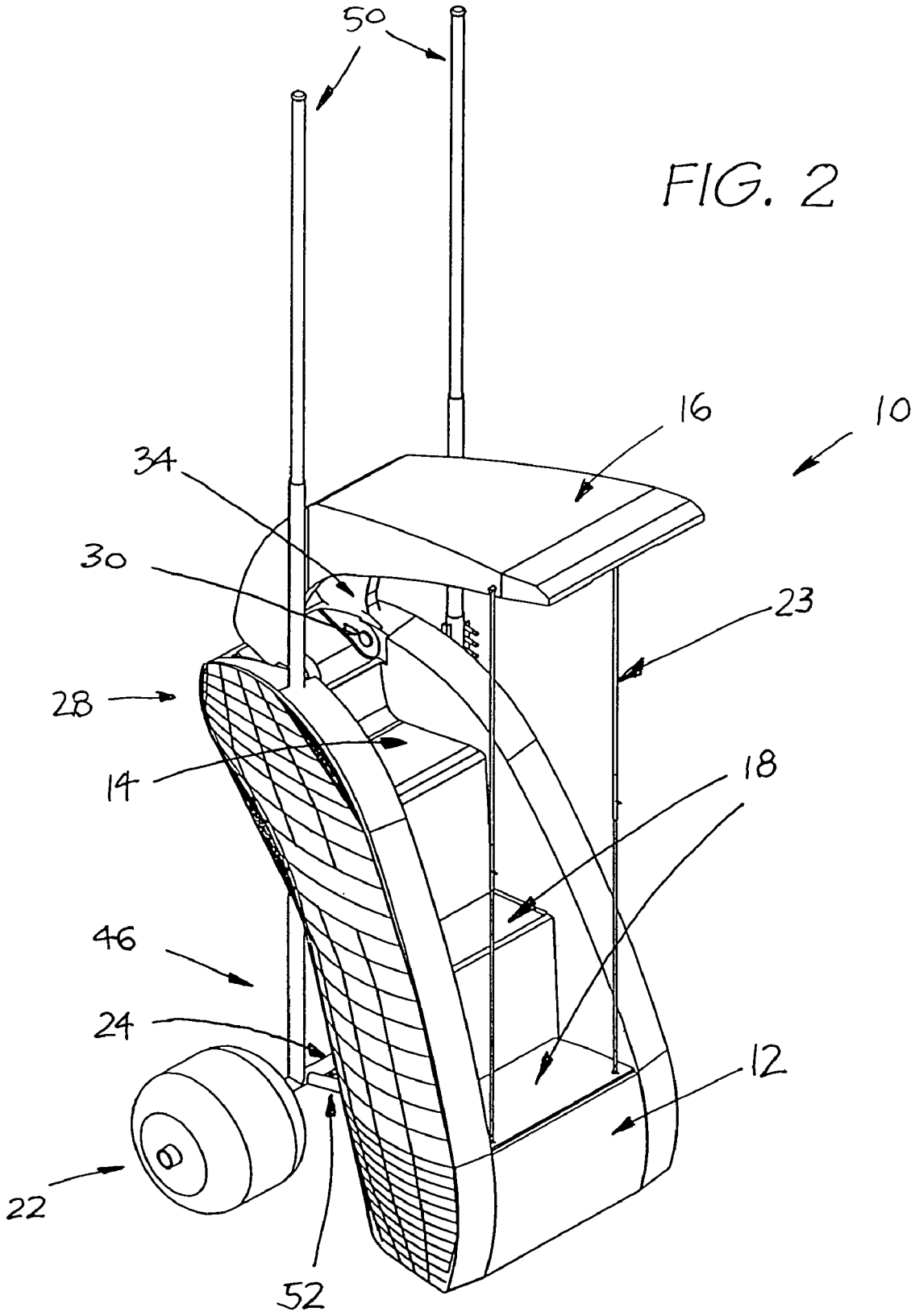
FIG. 2 shows a perspective schematic view of the embodiment shown in FIG. 1 when in the extended position.

Referring to the drawings, various embodiments of a seating apparatus are shown in FIGS. 1 to 12. FIGS. 1 and 2 show an apparatus 10 with a base in the form of an elongate banana-shaped body 12 and FIG. 2 shows that the body 12 includes a seat 14 at one end 28 thereof and two steps 18 leading to that seat 14, both the seat 14 and the steps 18 recessed into and integral with one side of the body 12. The body 12 also includes a member in the form of a pivotable lid 16 shaped as an outwardly convex rectangular panel. The lid 16 is pivotable with respect to the body 12 between a retracted position (as shown in FIG. 1) and an extended position (as shown in FIG. 2). As shown in FIG. 1 the lid 16 defines a cover for the recessed seat 14 and steps 18 and is attached to the body 12 at a pivot point which is positioned adjacent to the seat 14.

The attachment of the lid 16 at the pivot point includes a pin 30 which is fitted into a mating hole 32 in a web 34 which is located at one end of the lid 16, the web 34 being seated in a recess 36 located in the end 28 of the body 12 adjacent the seat 14. The pin 30 passes through the hole 32 in the web 34 and into a receiving hole located in the wall 38 of the recess 36. In further embodiments instead of using a pin, the lid may be pivoted about an axle or another equivalent pivoting or hinging arrangement provided at the lid which can accomplish the function of moving the lid between an extended and a retracted or closed position with respect to the body.

Figure 7:
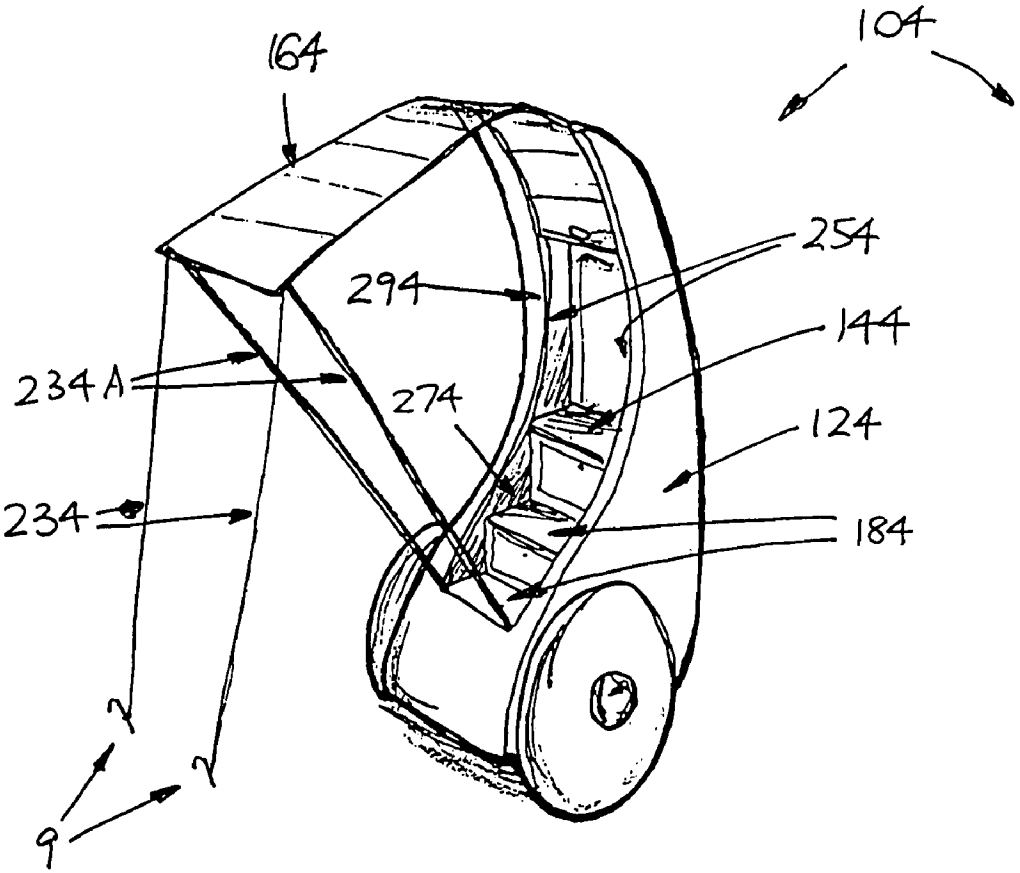
FIG. 7 shows a perspective schematic view an alternative embodiment of a seating apparatus in accordance with the invention, the apparatus shown in the extended position.

In the retracted position, the lid 16 lies flush with the body 12 (or at least parallel to the elongate body 12) and encloses the seat 14 and the steps 18 against use. When the lid 16 is pivoted into the extended position, a support in the form of a telescopic member 23 is extended between the lid 16 and the body 12 to enable the lid 16 to be supported open when in the extended position. In further embodiments the support can include a foldable or extendable connector which can accomplish the function of supporting the lid in an open position with respect to the body. In still further embodiments the telescopic, foldable or extendable connector can alternatively or additionally be directly connected to the surrounding ground by a ground engaging device such as a stake so that the lid is securely supported in the extended position, for example as shown in FIG. 7.

Figure 3:
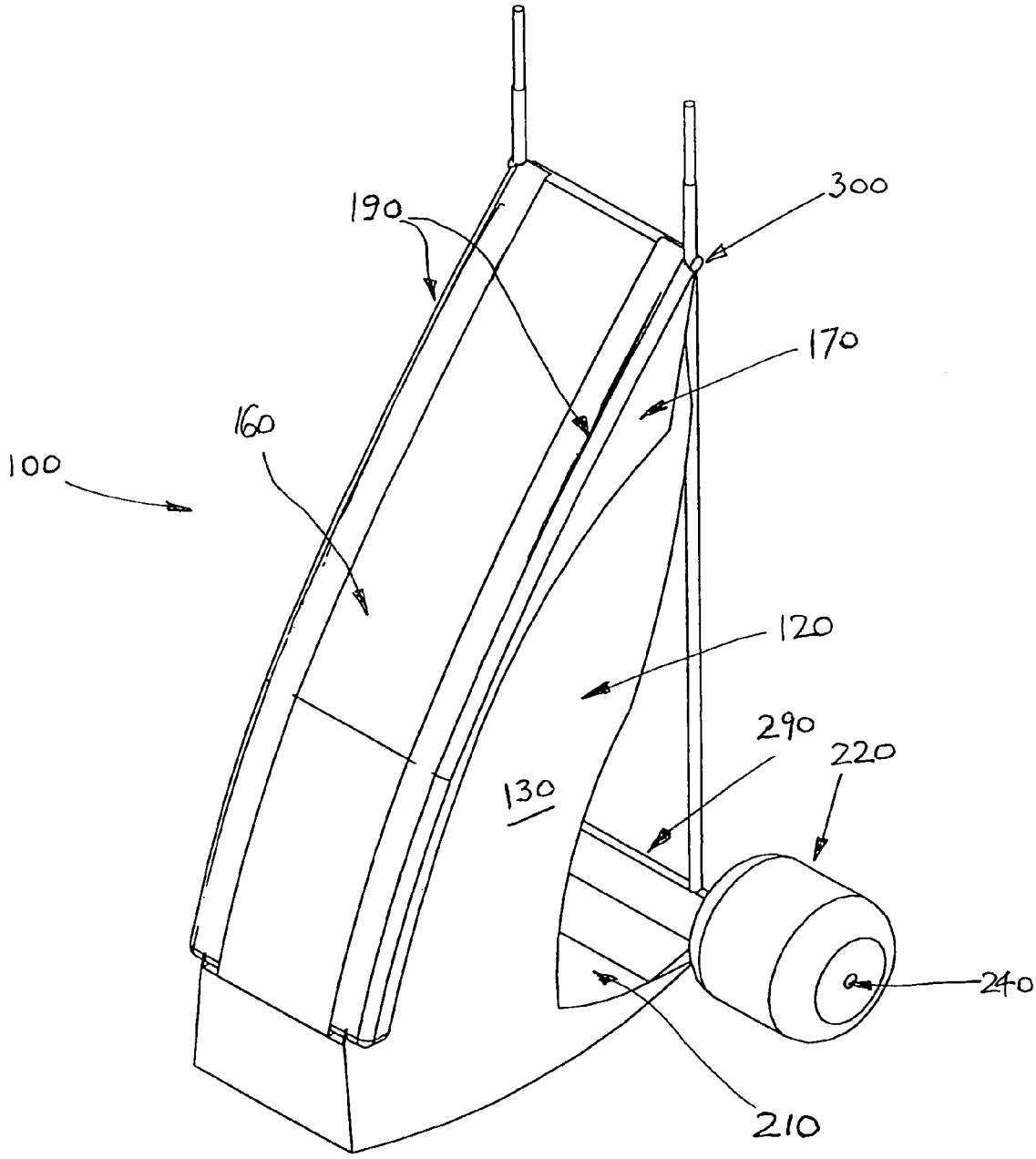
FIG. 3 shows a perspective schematic view an alternative embodiment of a seating apparatus in accordance with the invention, the apparatus shown in the retracted position.
Figure 4:
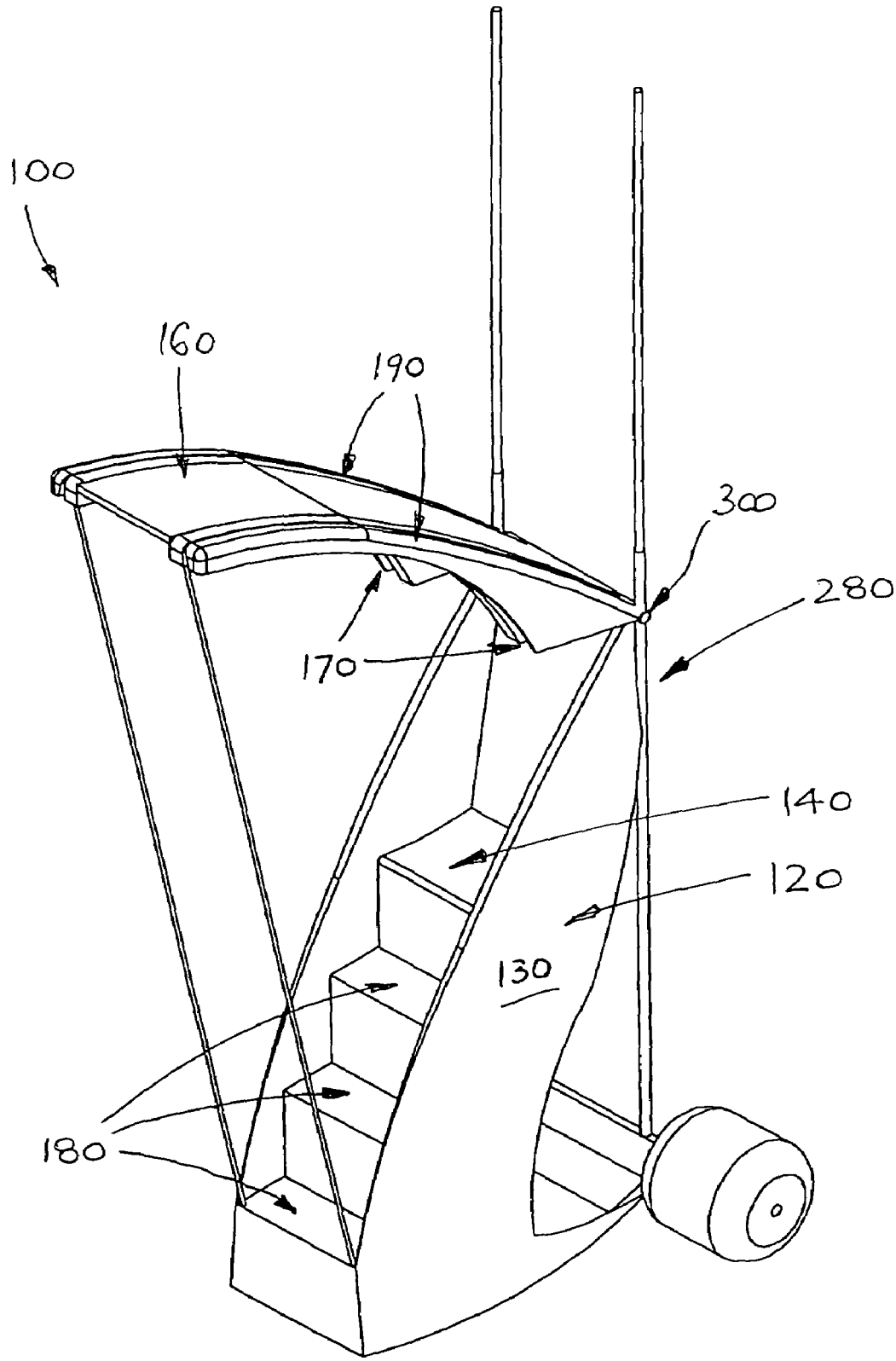
FIG. 4 shows a perspective schematic view of the embodiment shown in FIG. 3 when in the extended position.

FIGS. 3 and 4 depict another embodiment 100 of the seating apparatus, FIG. 3 showing a base in the form of an elongate banana-shaped body 120 and FIG. 4 showing that the body 120 includes a seat 140 at one end 280 thereof and three steps 180 leading to that seat 140. In this particular construction of the invention the attachment of the lid 160 at the pivot point includes a pin 300 which is fitted into a receiving hole located in the one end 280 of the body. In the retracted position shown in FIG. 3, the lid 160 lies flush with the body 120 to enclose the seat 140 and the steps 180 against use, and two orthogonal flanges 170 fitted on opposing elongate edges 190 of the lid 160 become located external to the side walls 130 of the body 120. In order to avoid repetition and for ease of reference, similar components and features of this alternative embodiment of the invention have been designated with an additional "0", such as the body 120.

Figure 5:
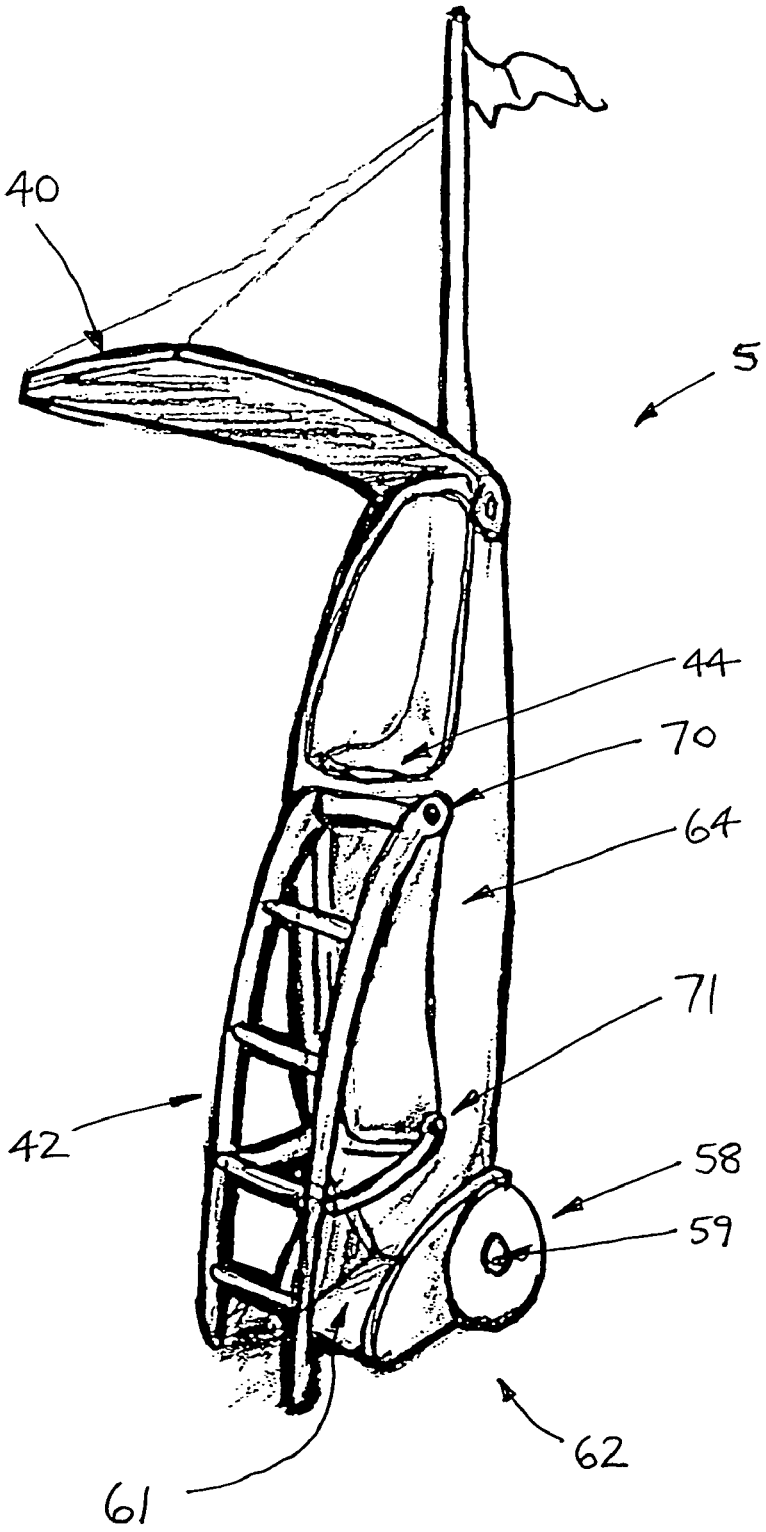
FIG. 5 shows a perspective schematic view an alternative embodiment of a seating apparatus in accordance with the invention, the apparatus shown in the extended position.

The two recessed, integral steps 18 shown in FIG. 2 and the three recessed, integral steps 180 shown in FIG. 4 are positioned adjacent to the respective seat 14, 140 to provide access for the user to step up to the seat 14, 140 when the respective apparatus 10, 100 is positioned upright in use. In further embodiments of the invention, such as the apparatus 5 shown in FIG. 5, the steps can be externally attachable to the body 64 or be replaced by a ladder 42 or equivalent climbing frame that facilitates this ready access. The ladder 42 shown in FIG. 5 is attached to the body 64 and is pivotable at two pin mounts 70, 71 although in further embodiments it is not necessary for the ladder 42 to pivot with respect to the body 64.

While in some embodiments (for example in FIGS. 1 and 2) the lid 16 in the retracted position cooperates with the body 12 to also enclose the steps 18 as well as the seat 14 against use, in other embodiments of the invention the lid need not necessarily enclose the step arrangement. For example, in the embodiment shown in FIG. 5 the lid 40 which pivots relative to body 64 does not enclose the ladder 42 which provides user access to the enclosable seat 44.

Figure 6:
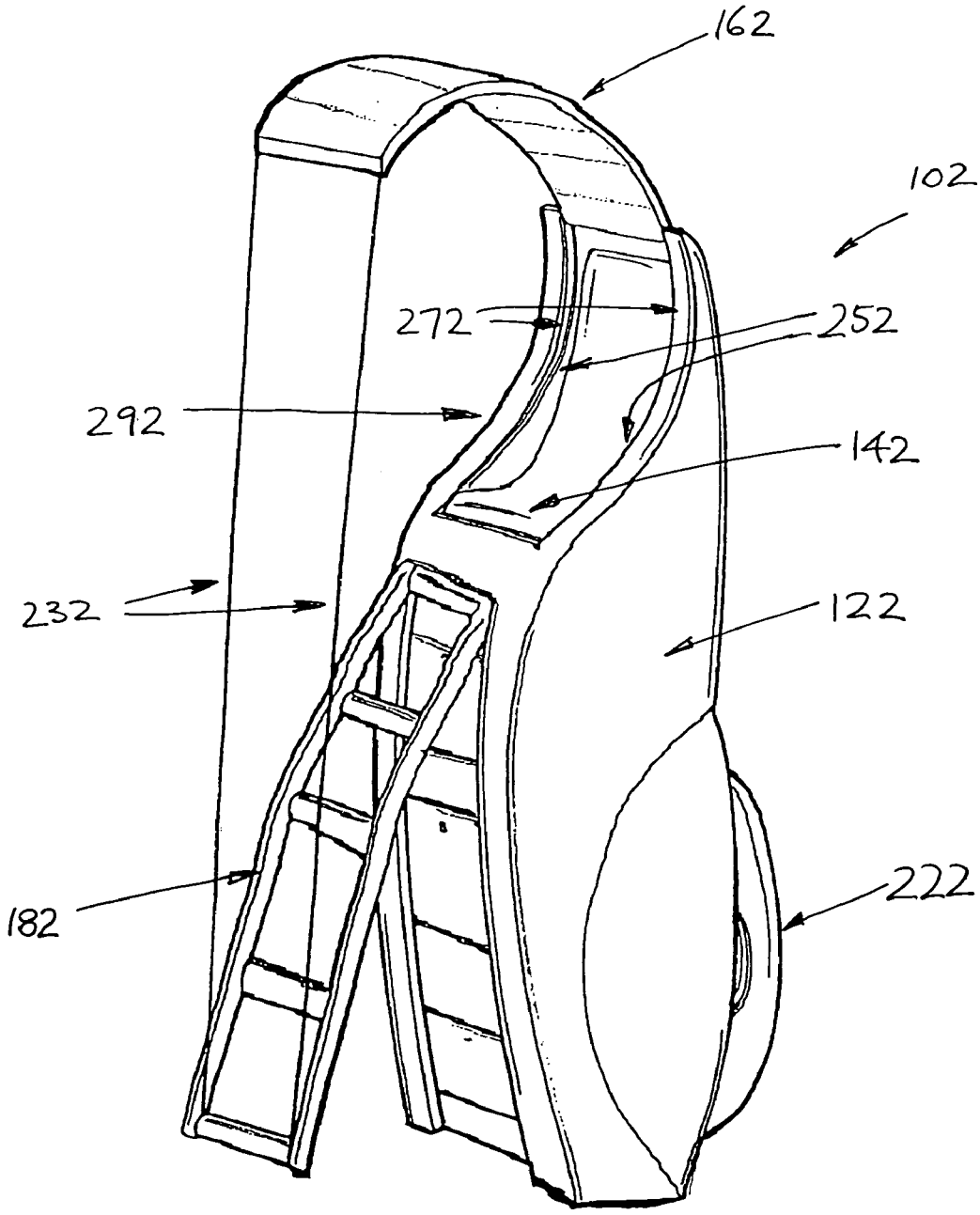
FIG. 6 shows a perspective schematic view an alternative embodiment of a seating apparatus in accordance with the invention, the apparatus shown in the extended position.
Figure 6A:
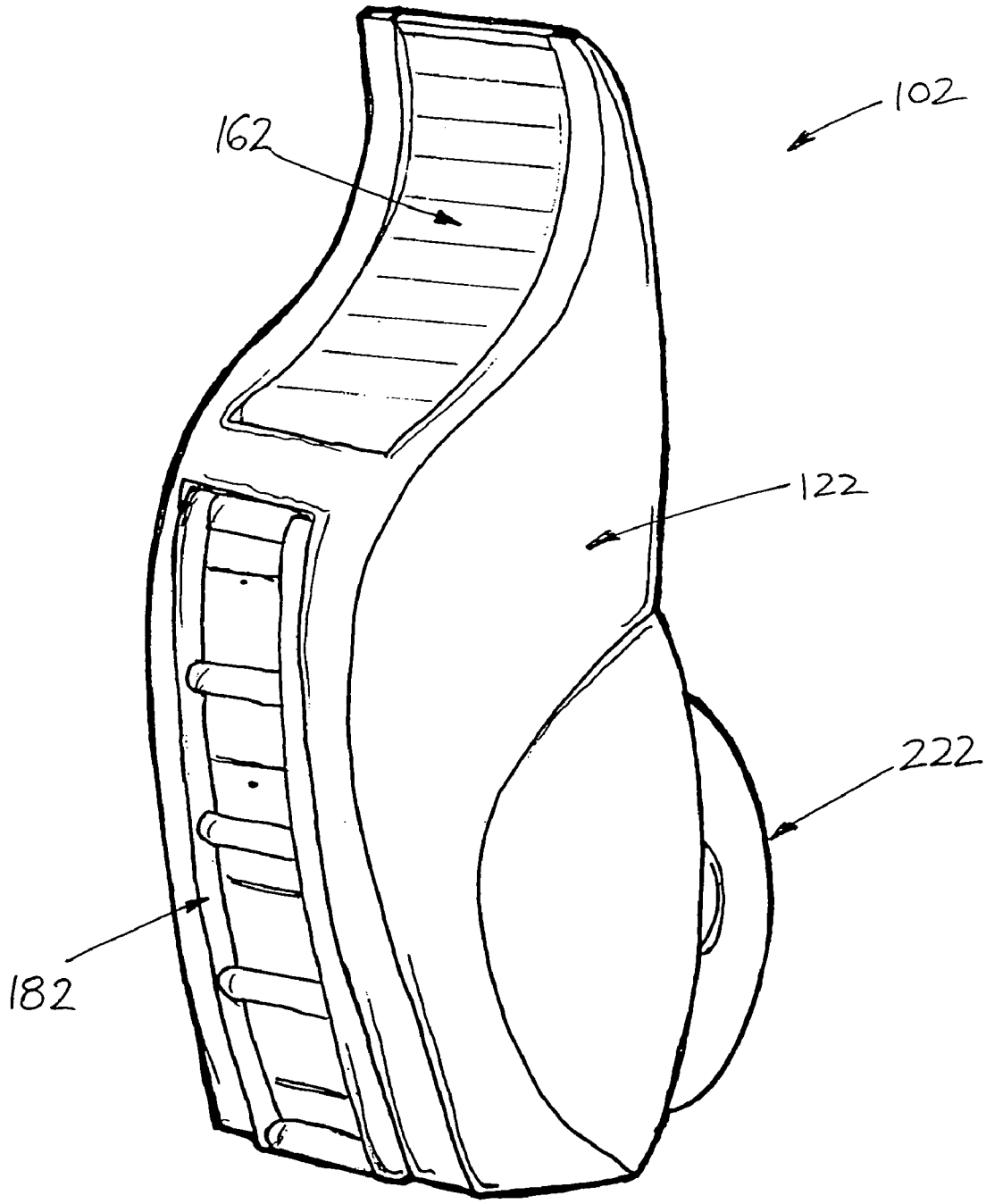
FIG. 6A shows a perspective schematic view of the embodiment shown in FIG. 6 when in the retracted position.

FIG. 6 depicts another embodiment 102 of the seating apparatus, showing a base in the form of an elongate body 122, the body 122 including a step ladder 182 with four rungs leading to a seat 142. In this particular construction of the invention the lid 162 slides relative to the body 122 to enclose only, when in a retracted position, the seat 142 against use (FIG. 6A). The lid 162 is attached to the body and fitted in two slots 252 provided on the body 122, the slots 252 extending along two inner faces 272 of the opening 292 in the body 122 for the recessed seat 142. In the extended position shown in FIG. 6, the lid 162 is freely extended above the body 122 to provide overhead shelter for the seat 142. In this embodiment extendable connectors 232 are secured to a base of the step ladder 182 so that the lid 162 is securely supported in the extended position. FIG. 6A shows the present embodiment 102 where the lid 162 has been moved to enclose the seat 142 against use. In order to avoid repetition and for ease of reference, similar components and features of this alternative embodiment of the invention have been designated with an additional "2", such as the body 122.

Figure 8:
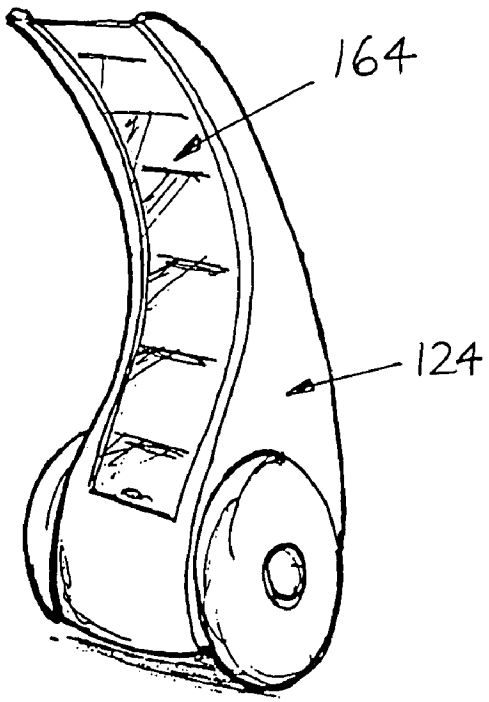
FIG. 8 shows a perspective schematic view of the embodiment shown in FIG. 7 when in the retracted position.
Figure 8A:
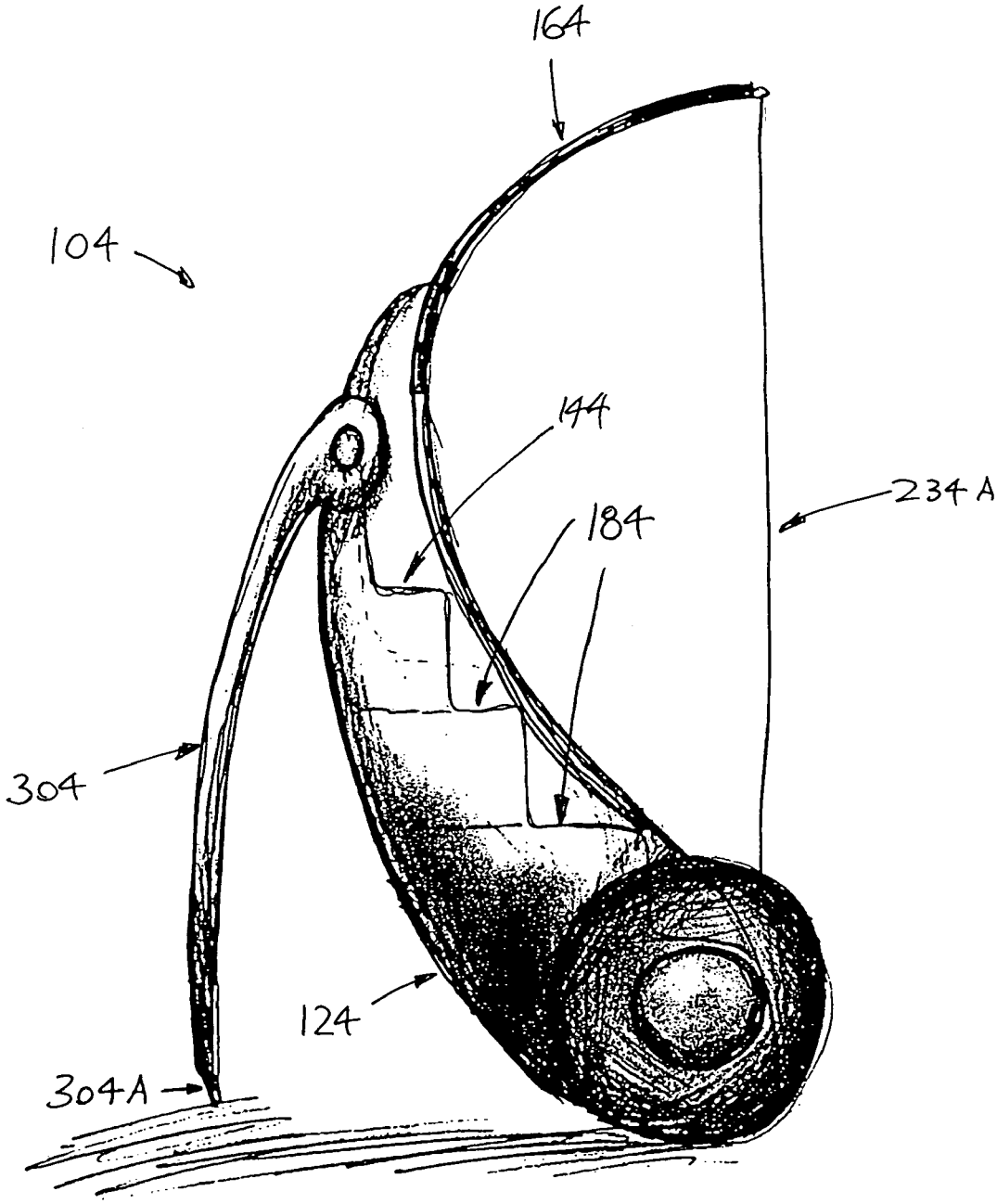
FIG. 8A shows a part-sectional side view of the embodiment shown in FIG. 7 when in the extended position.

FIG. 7 depicts another embodiment 104 of the seating apparatus, showing a base in the form of an elongate body 124, the body 124 including two steps 184 leading to seat 144. In this particular construction of the invention the lid 164 slides relative to the body 122 to enclose both the seat 144 and the steps 184 against use. The lid 164 is attached to the body and fitted in two slots 254 provided on the body 124, the slots 254 extending along two opposing inner faces 274 of the opening 294 in the body 124 for the recessed seat 144. In the extended position shown in FIG. 7, the lid 164 is freely extended above the body 122 to provide overhead shelter for the seat 144. In this embodiment extendable connectors 234 are secured to a base of the step ladder 182 and further connectors 234A are each secured to the surrounding ground by ground engaging stakes 9 so that the lid 162 is securely supported in the extended position. FIG. 8 shows the present embodiment 104 where the lid 164 has been retracted to enclose the seat 144 and the steps 184 against use. FIG. 8A shows a side view of the present embodiment in the extended position and also shows a pivotal supporting arm 304 joined to and moveable away from the body 122, the arm having a ground engaging tip 304A, the arm 304 and the tip 304A providing stabilisation for the body 102 when positioned upright in use. In order to avoid repetition and for ease of reference, similar components and features of this alternative embodiment of the invention have been designated with an additional "4", such as the body 124.

Figure 9:
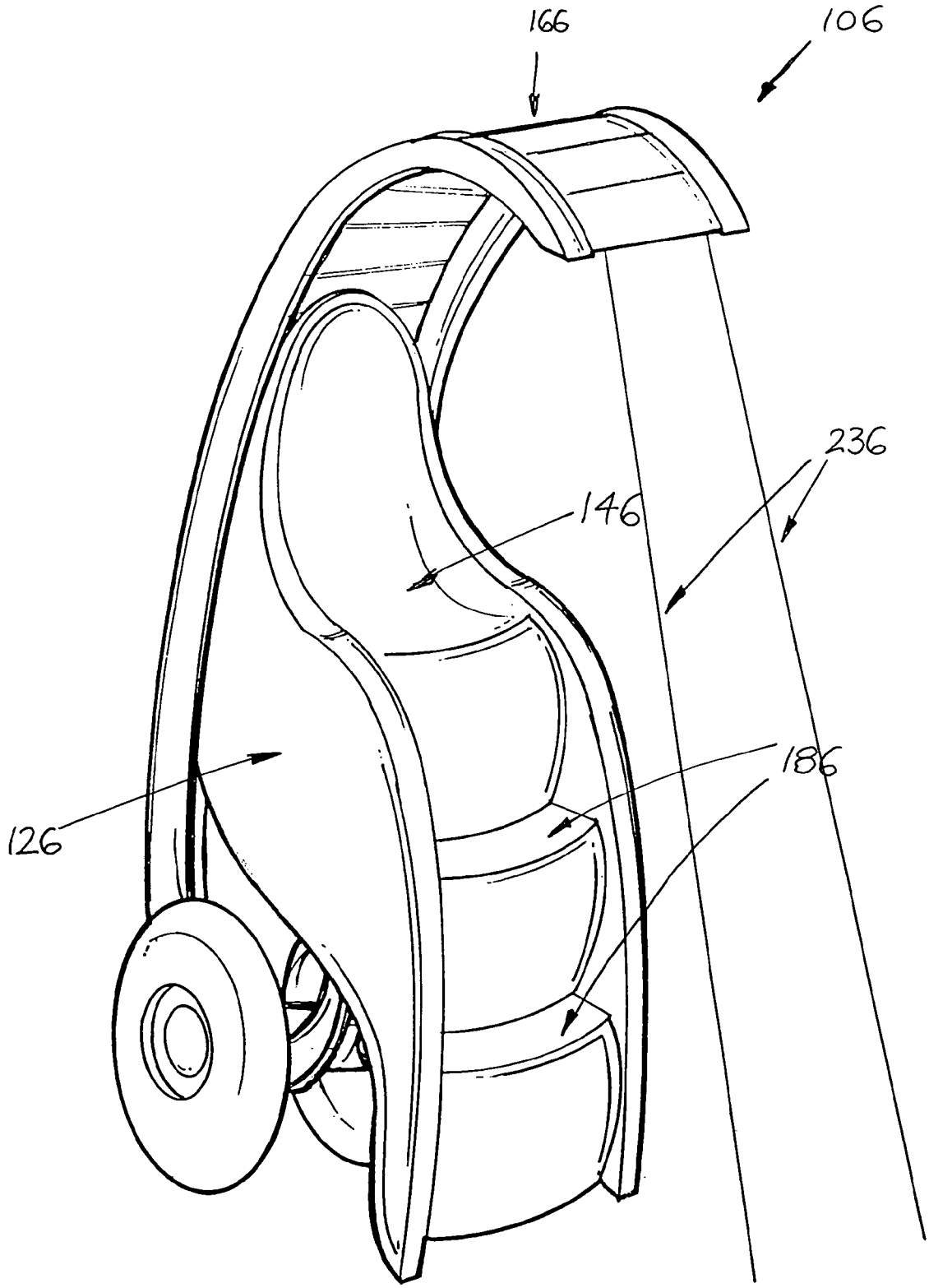
FIG. 9 shows a perspective schematic view an alternative embodiment of a seating apparatus in accordance with the invention, the apparatus shown in the extended position.
Figure 10:
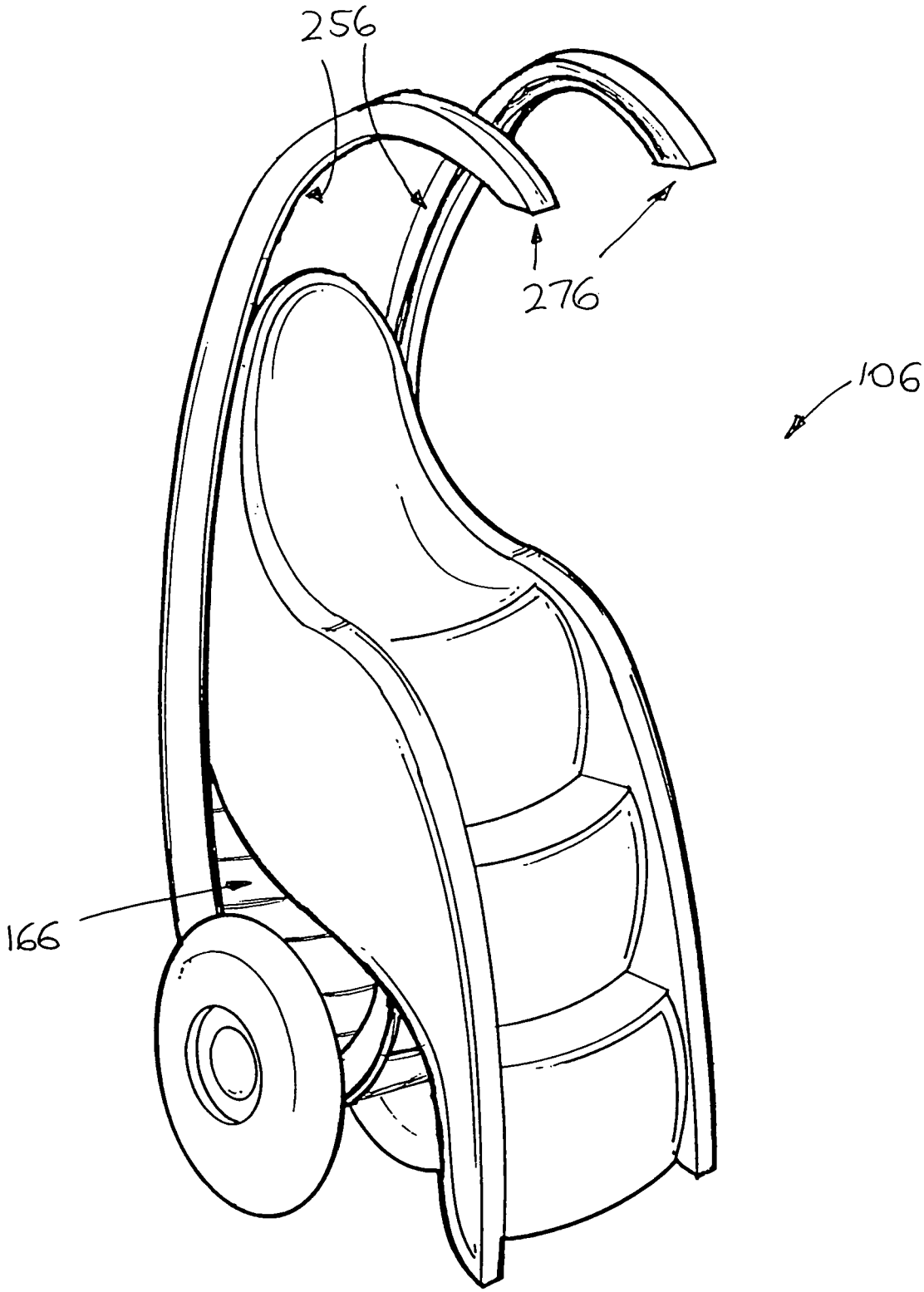
FIG. 10 shows a perspective schematic view of the embodiment shown in FIG. 9 when in the retracted position.

FIG. 9 depicts another embodiment 106 of the seating apparatus, showing a base in the form of an elongate body 126, the body 126 including two steps 186 leading to the seat 146. In this particular construction of the invention the lid 166 slides relative to the body 126 in a pair of retaining tracks 256 where the elongate sides of the lid 166 are retained in the tracks 256, and the tracks 256 are located on the innermost surfaces of two curved arms 276 which are attached on either side of and extend above the body 126. When the lid 166 is retracted it is positioned on the opposing side of the body 126 to the steps as shown in FIG. 10. In the extended position shown in FIG. 9, the lid 166 is extended above the body 126 to provide overhead shelter for the seat 146. In further embodiments, any type or number of rail, slot or other tracking system can be used to retain and allow sliding movement of the lid 166, and the arms which support the tracking need not be curved but can instead include, for example, both a vertical and horizontal portion, the latter portion located above the seat 146. In still further embodiments, the lid can be retracted into a recess or cavity formed in the rear of the body 126 to provide greater protection for the lid when the apparatus 106 is in storage, for example. In the present embodiment extendable connectors 236 are shown which are optionally used to secure the lid 166 to surrounding ground so that the lid 166 is securely supported in the extended position. In order to avoid repetition and for ease of reference, similar components and features of this alternative embodiment of the invention have been designated with an additional "6", such as the body 126.

Figure 12:
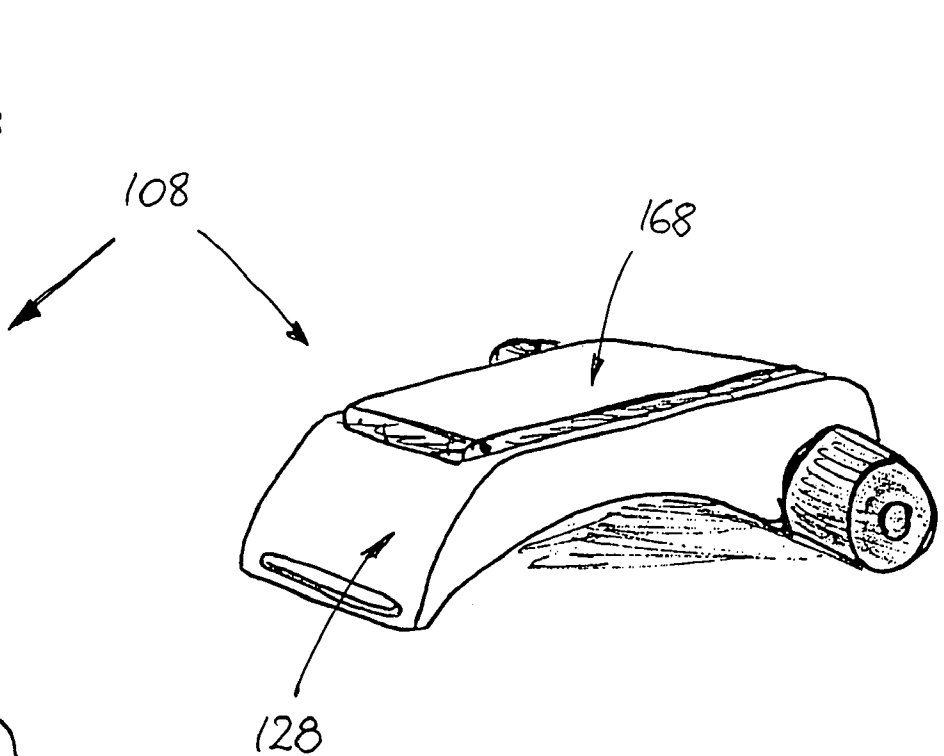
FIG. 12 shows a perspective schematic view of the embodiment shown in FIG. 11 when in the retracted position.
Figure 11:
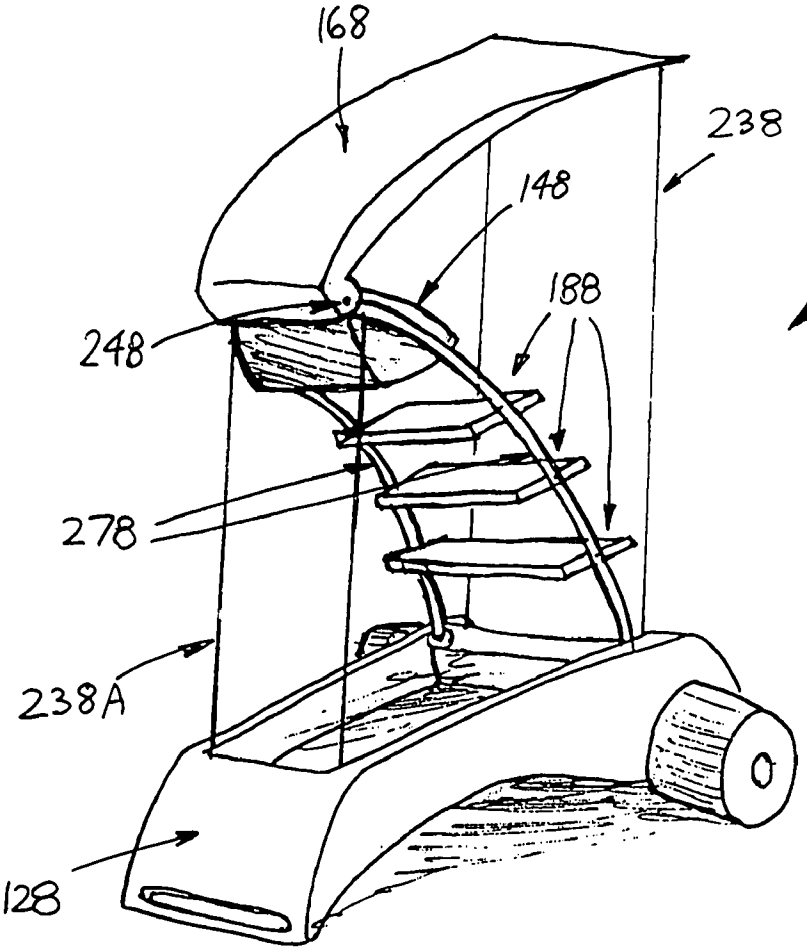
FIG. 11 shows a perspective schematic view an alternative embodiment of a seating apparatus in accordance with the invention, the apparatus shown in the extended position.

FIG. 11 depicts another embodiment 108 of the seating apparatus, showing a base in the form of a carriage 128 including a pair of retractable arms 278 moveable from and above the carriage 128, each arm pivotally attached to three steps 188 for leading to the seat 148. In use of this particular construction of the invention, the steps 188 and the seat 148 can be raised on arms 278 from a folded away position, as shown in FIG. 12, to a raised position as shown in FIG. 11. In the folded away position the lid 168 pivots relative to the carriage 128 to enclose both the seat 148 and the steps 188 against use. The lid 168 is attached to the carriage at the seat 148 and is pivotable about an axle or other pin arrangement 248 provided on the seat 148. In the extended position shown in FIG. 11, the lid 168 is freely extended above the carriage 128 to provide overhead shelter for the seat 148. In this embodiment extendable connectors 238 are secured between the carriage and the lid 168 so that the lid 168 is securely supported in the extended position. Further connectors 238A secure the seat 148 to the carriage 128. FIG. 12 shows the present embodiment 108 where the lid 168 has been moved to enclose the seat 148 and the steps 188 against use. In order to avoid repetition and for ease of reference, similar components and features of this alternative embodiment of the invention have been designated with an additional "8", such as the carriage 128.

In the embodiment shown in FIGS. 1 and 2, the body 12 is fitted with a pair of wheels 22 located on an axle 24 to allow movement of the apparatus 10 and to permit tilting of the apparatus 10 into a position whereat the seat 14 is located uppermost in the body 12, and the steps 18 are arranged to enable climbing into the seat 14. Typically the wheels are rubber tires although in further embodiments moulded plastic wheels can be used. The axle arrangement shown in FIGS. 1 and 2 is supported by a chassis frame 46 which is screwed 48 or otherwise attached to one side of the body 12, the chassis frame 46 including support rods 52 and support plate 54. The chassis frame 46 also includes a pair of elongate handles 50 extending from the wheel axle 24 to beyond the upper end 28 of the body 12 and attached to the sides of that body 12. A user can position themselves between the two handles 50 and pull the apparatus 10 along in its tilted position much in the manner of pulling a rickshaw or an oxen pulling a plough. The handles 50 also facilitate tilting of the apparatus 10 into and out of its upright position, shown in FIG. 2.

Other arrangements of wheels and axles which can accomplish the same movement task are also suitable, including the arrangements shown in FIGS. 3 and 4 and in FIGS. 6 and 6A for example. In the embodiment shown in FIGS. 6 and 6A only a single wheel 222 is used. In FIG. 3 the pair of wheels 220 is located on an axle 240 positioned in a slot located in the end 290 of a basal wing 210 which extends rearwardly from one side of the body 120 and rests at least partially on the surrounding ground in use. The basal wing 210 is predominantly planar and when the apparatus 100 is in use on a beach, for example, sand or sandbags can be placed on top of the wing 210 to bury it and provide additional support for the apparatus 100 when located in its upright position. In the further embodiment shown in FIG. 5, the pair of wheels 58 is located on an axle 59 positioned in a slot located at the rear of the base end 62 of the banana-shaped body 64, and a planar basal wing 61 extends from the foreportion of the base end 62 of the body 64 for a similar purpose.

In further embodiments of the invention other shaped lids and body shapes can be utilised depending on the intended application. For example the seats in such apparatus can be configured to accommodate two or more persons depending on the chosen width of the apparatus. Any number of steps or ladder rungs is within the scope of the invention to permit the apparatus to be located at a convenient height. Depending on the requirements, the base end of the body or an attachment to the body (for example ground engaging tip 304A in FIG. 8A) can have removable spikes fitted thereto to facilitate positioning of the apparatus 10 in the surrounding sand or ground in order to stabilise the apparatus in use. Alternatively a peripheral edge of the base can be sharp or pointed for the same reason.

The apparatus 10 shown in FIGS. 1 to 12 is typically used for a beach application as a viewing platform for a lifeguard and the apparatus can be adapted for the external attachment of such items as a surfboard, flagpoles and lifebelts. For example, in the embodiment shown in FIGS. 1 and 2, a surfboard can be strapped onto the outer surface of the lid 16 and the pulling handles 50 can be detachable to provide safety flagpoles that can be positioned in the sand. Alternatively the safety flagpoles can be slidingly inserted within each handle 50. Further, all manner of additional apparatus can be stored internally in the space within the body 12 and accessed via a portal provided on an opposing side of the body 12 to the steps 18, or via an openable panel in the steps themselves, for example as a liftable step to access a formed containment there below. In some embodiments (for example as shown in FIGS. 1 and 2) the steps 18 and the lid 16 also define a storage space therebetween that is enclosable when the lid 16 is in the retracted position. Stored items can include medical kits and other safety devices including radios, loud hailers, spine boards, flotation devices, blankets, binoculars and so forth.

In use the apparatus can be used to provide a raised and covered mobile surveillance seat for use in or near locations as diverse as swimming pools, football fields, school playgrounds and beaches. The apparatus offers substantial improvements and advantages over existing raised seats, observation towers and the like. The known apparatus usually comprises a ladder which reaches up a scaffold-type support frame or tower, and features a non-rigid overhead covers which provided only temporary physical protection for the occupier of the seat. The materials of construction of such devices usually gave minimum wind and weather (sun and rain) protection for the seated person. By contrast, the use of a rigid, pivotable cover to provide shelter for a seat offers a sturdy, secure, UV-proof, waterproof and convenient alternative apparatus with the additional benefit of the cover cooperating with the seat and seat base to fold away during periods of non-use.

Furthermore, there are no obstructions to surveillance of the surrounding area of supervision using the apparatus of the present invention because of the location of the join between the seat cover and the base at a pivot point behind the seat. As mentioned earlier, the apparatus can also provide a unique stand alone storage device in a remote location such as a beach. The apparatus can be readily fitted with a conventional cover locking mechanism to secure the cover segment in position.

It is also within the scope of the invention for the apparatus to be fixed in position rather than being only portable or wheelable in construction. When fitted with wheels, the invention could be moved either on a trailer connected to a prime mover, or by being directly connected to the prime mover itself as a trailer. Alternatively the apparatus can be designed to slide over sand or ground surfaces, in a similar fashion to a sleigh or snowboard, for example.

In all of the seating apparatus described hereinbefore, the base and cover member is manufactured of strong and lightweight materials such as powder-coated metals, laminated metal sheets, painted or laminated timbers or composite materials such as carbon fibre, fibreglass or rigid plastics, or a combination of these. The apparatus must be sufficiently lightweight to be moveable across the sand of a beach without sinking or bogging in the sand, and when erected the apparatus should not be too lightweight such that it is susceptible to being toppled or blown over in a strong wind. As there is extreme contact with UV light, salt, water and abrasives such as sand, the materials of construction need to be stable in such circumstances. It is most advantageous if the apparatus can be moved easily by one or a small number of lifesavers to a preferred location, and easily erected by a similar few persons.

Mobile beach observation seats such as the present invention allow the lifesaver to reposition his or her apparatus to follow the constantly changing conditions which occur at the beach. Movements in rips, holes, currents and tides constantly cause revision of the location of beach flags and lifesaver observation positions. Currently, lifesavers are required to take shelter under an umbrella and to pack up and move their safety equipment and umbrella at various times of the day. The disadvantage of the previous arrangements is that the viewpoint of the beach is only from sand level, without appropriate elevation, which can only be provided by fixed scaffold-type support frames or towers.

The seating apparatus of the present invention can provide both a portable safety device and a sturdy covered seat for surveillance purposes. The invention provides an improved apparatus for provision of such covered seating as well as facilitating the formation of raised seating in a simple and rapid fashion.

Whilst the invention has been described with reference to several preferred embodiments it should be appreciated that the invention can be embodied in many other forms.

I claim:

1. A raised viewing platform for seating a human occupant, the viewing platform comprising:

a base including a seat and one or more steps for leading up to the seat;

a member moveable with respect to the base between a retracted position and an extended position in which the member is disposed over the seat; and wherein, when the member is located in the extended position, the member is disposed over a seated human occupant so as to provide physical protection for the occupant, and wherein the step(s) and the member define a storage space that is enclosable when the member is in the retracted position.

2. A platform as claimed in claim 1 wherein the member is pivotable at the base between the retracted and extended positions.

3. A platform as claimed in claim 1 wherein in the retracted position the member cooperates with the base to enclose the seat against use.

4. A platform as claimed in claim 3 wherein in the retracted position the member cooperates with the base to also enclose the step(s) against use.

5. A platform as claimed in claim 1 wherein the member is attached to the base at a pivot point which is positioned at or adjacent to the seat.

6. A platform as claimed in claim 1 further including a support positionable between the member and the base or between the member and surrounding ground for supporting the member when in the extended position.

7. A platform as claimed in claim 6 wherein the support is one or more foldable, extendable or telescopic connectors.

8. A platform as claimed in claim 1 wherein the member is a segment in the form of an outwardly convex rectangular panel, and the base shape approximates a longitudinal prism, the member sitting flush with the base in the retracted position.

9. A platform as claimed in claim 1 wherein the member is slidable between the retracted and extended positions.

10. A platform as claimed in claim 9 wherein in the retracted position the member cooperates with the base to enclose the seat against use.

11. A platform as claimed in claim 9 wherein the member is attached to the base in a track or slot provided at the base, the track or slot extending along the base adjacent the seat and the step(s) so that in the retracted position the member cooperates with the base to also enclose the step(s) against use.

12. A platform as claimed in claim 9 further including a support positionable between the member and the base or between the member and surrounding ground for supporting the member when in the extended position.

13. A platform as claimed in claim 9 wherein the support is one or more foldable, extendable or telescopic connectors.

14. A platform as claimed in claim 9 wherein the member is a segment in the form of a flexible rectangular panel, and the base shape approximates a longitudinal prism, the member sitting flush with the base in the retracted position.

15. A platform as claimed in claim 9 wherein in the retracted position the member is received in an internal recess provided in an opposing side of the base to the step(s) or in an external retaining track or slot provided on the opposing side.

16. A platform as claimed in claim 15 wherein the member is a segment in the form of a flexible rectangular panel, and the base shape approximates a longitudinal prism, the panel seated within the base or at the opposing side of the base in the retracted position.

17. A platform as claimed in claim 9 further including a support positionable between the member and the base or between the member and surrounding ground for supporting the member when in the extended position.

18. A platform as claimed in claim 17 wherein the support is one or more foldable, extendable or telescopic connectors.

19. A platform as claimed in claim 1 wherein the step(s) are integral with the base.

20. A platform as claimed in claim 1 wherein the step(s) are part of a ladder that is optionally pivotally mounted to the base.

21. A platform as claimed in claim 1 wherein the base is fitted with one or more wheels to allow movement of the apparatus and to permit tilting of the apparatus into a position whereat the seat is located uppermost in the base and the step(s) are arranged to enable climbing into the seat.

22. A platform as claimed in claim 1 wherein the base includes a projecting wing at its in use lowermost end that helps stabilize the base when in the upright position.

23. A platform as claimed in claim 1 wherein the base is further adapted for the external attachment of equipment comprising one of a surfcraft or a flagpole.

24. A platform as claimed in claim 1 wherein the base has internal storage defined therein which is enclosed by an access portal provided on an opposing side of the base to the step(s) or enclosed by an access portal provided in the step(s).

25. A raised viewing platform for seating a human occupant, the viewing platform comprising:

a base including a seat and one or more steps for leading up to the seat; and a member moveable with respect to the base between a retracted position and an extended position in which the member is disposed over the seat; and wherein, when the member is located in the extended position, the member is disposed over a seated human occupant so as to provide physical protection for the occupant, and wherein the base has internal storage defined therein which is enclosed by an access portal provided on an opposing side of the base to the step(s) or enclosed by an access portal provided in the step(s).

26. A platform as claimed in claim 25 wherein the member is pivotable at the base between the retracted and extended positions.

27. A platform as claimed in claim 25 wherein in the retracted position the member cooperates with the base to enclose the seat against use.

28. A platform as claimed in claim 27 wherein in the retracted position the member cooperates with the base to also enclose the step(s) against use.

* * * * *